United States Patent [19]

Ohno

[11] Patent Number: 4,908,858

[45] Date of Patent: Mar. 13, 1990

[54] STEREO PROCESSING SYSTEM

[75] Inventor: Matsuo Ohno, 17-7, Minami-aoyama 3-chome, Minato-ku, Tokyo, Japan, 107

[73] Assignees: Matsuo Ohno; Kabushiki Kaisha Asaplan, both of Tokyo, Japan

[21] Appl. No.: 166,181

[22] Filed: Mar. 10, 1988

[30] Foreign Application Priority Data

Mar. 13, 1987 [JP] Japan ..... 62-58435

[51] Int. Cl.[4] ..... H04S 1/00

[52] U.S. Cl. ..... 381/1; 381/17; 381/18; 381/98

[58] Field of Search ..... 381/1, 17, 18, 19, 20, 381/21, 22, 23, 98, 24

[56] References Cited

U.S. PATENT DOCUMENTS

| | | | |
|---|---|---|---|
| 4,121,059 | 10/1978 | Nakabayashi | 381/1 |
| 4,137,510 | 1/1979 | Iwahara | 381/100 |
| 4,525,857 | 6/1985 | Orban | 381/100 |
| 4,748,669 | 5/1988 | Klayman | 381/1 |

*Primary Examiner*—Forester W. Isen

*Attorney, Agent, or Firm*—W. Edward Johansen; Kenjiro Hidaka

[57] ABSTRACT

A stereo processing system which comprises a left channel and a right channel; a filter in each of the channels for separating an audio signal into a plurality of bands; a phase-shift/delay circuit in each of the channels for receiving a portion of the output of the corresponding filter and phase-shifting and delaying the received signal for each of the separated bands; a pair of input/output circuits interconnecting the left channel and the right channel for exchanging the signals between the two phase-shift/delay circuits for mixing the signal received from the filter of the left channel with the signal received from the phase-shift/delay circuit of the right channel in the phase-shift/delay circuit of the left channel and vice versa; a mixing circuit in each of the channels for mixing the signal received from the output of the corresponding filter with the output of the corresponding phase-shift/delay circuit; and a phase detector/delay circuit coupled to the outputs of the mixing circuits of the left and the right channels for detecting and delaying a portion of the signal received from the mixing circuit of the left channel having a 180° phase-shift with respect to the signal received from the mixing circuit of the right channel and vice versa.

6 Claims, 4 Drawing Sheets

(a)

(b)

(c)

STEREO PROCESSING SYSTEM

BACKGROUND OF THE INVENTION

1. Field of the Invention

This invention relates to a stereo processing system, and more particularly to a stereo processing system for reproducing a spatial sound field or constituting a three-dimensional auditory perspective.

2. Description of the Prior Art

Recently, in the field of an audio system, sound processing techniques for giving a spatially expanding or spreading sensation to listeners have been achieved by a stereo processing system having a surround-sound processor.

The most common stereo processing systems known heretofore have a delay circuit. These stereo processing systems are adapted to reproduce indirect sounds reflected by walls or ceilings of an auditorium. More particularly, the conventional systems have a delay circuit for producing sounds having some delay with respect to original sounds, so that the delayed sounds may be reproduced together with the original sounds through loudspeakers.

Although these conventional stereo processing systems can impart some sound spreading sensation to listeners by the provision of the delay circuits, the sensation these system can provide is based on mere "spreading" or "expanding" effect and the systems can not successfully provide a real auditory perspective or a spatial sound field.

There has been another stereo processing system known as a Dolby stereo system ("Dolby" is a registered trademark owned by Dolby Laboratories, Great Britain), which consists essentially of two-channel stereo amplifiers and two front and two rear (or three front and one rear), four in total, loudspeakers. According to the Dolby system, sounds which have been subjected to phase-shifting by 180° are recorded and only the sounds having a 180° phase difference are detected to be reproduced, in a monophonic way, through the rear loudspeaker or loudspeakers.

This Dolby stereo system can reproduce a spatial sound field to some extent, but this has a disadvantage that the back and forth movement of the sounds are too rapid or that sound expanding or spreading effect in the sideward direction is not satisfactory. Or, more essentially, this system is completely of no use to the media which have been encoded by a system other than the Dolby system.

SUMMARY OF THE INVENTION

Object of the Invention

It is the primary object of the present invention to provide a stereo processing system which is capable of giving the listeners the same audio perspective or spatial sound field as is provided when original sounds reach a microphone system.

Feature of the Invention

The present invention features a stereo processing system which comprises: a left channel and a right channel; a filter circuit means in each of the left and the right channels for separating a stereo audio signal into a plurality of bands; a phase-shift/delay circuit means in each of the left and the right channels provided with an input/output circuit interconnecting the two phase-shift/delay circuits, for phase-shifting and delaying a portion of the output from each filter circuit means according to the respective bands; a mixing circuit means in each of the left and the right channels mixing the output from the corresponding filter circuit means with the output from the corresponding phase-shift-/delay circuit means. Each phase detector/delay circuit means detects a 180° phase-shifted component from a portion of the output from the corresponding mixing circuit means and delays the component.

With this arrangement, formation of 360° sound field and spatial localization can be attained, enabling the selection of a listening position to be more free and permitting the selection from a widened range. More particularly, the arrangement of the present invention can provide such stereo effects that the listener receives the sensation that individual sounds are coming from different locations, just as did the original sounds reaching the microphone system. Namely, for example, the back and forth movement of the sounds are smooth, the sound expanding or spreading in the lateral direction is natural, localization to the head field of the listener can be attained, sounds can be heard by the listener as if they just pass by his ears, low-frequency sounds can also be heard moving, and the audible area is widened.

PREFERRED EMBODIMENT OF THE PRESENT INVENTION

An embodiment of the present invention will now be described in reference to the drawings.

Figure 1:
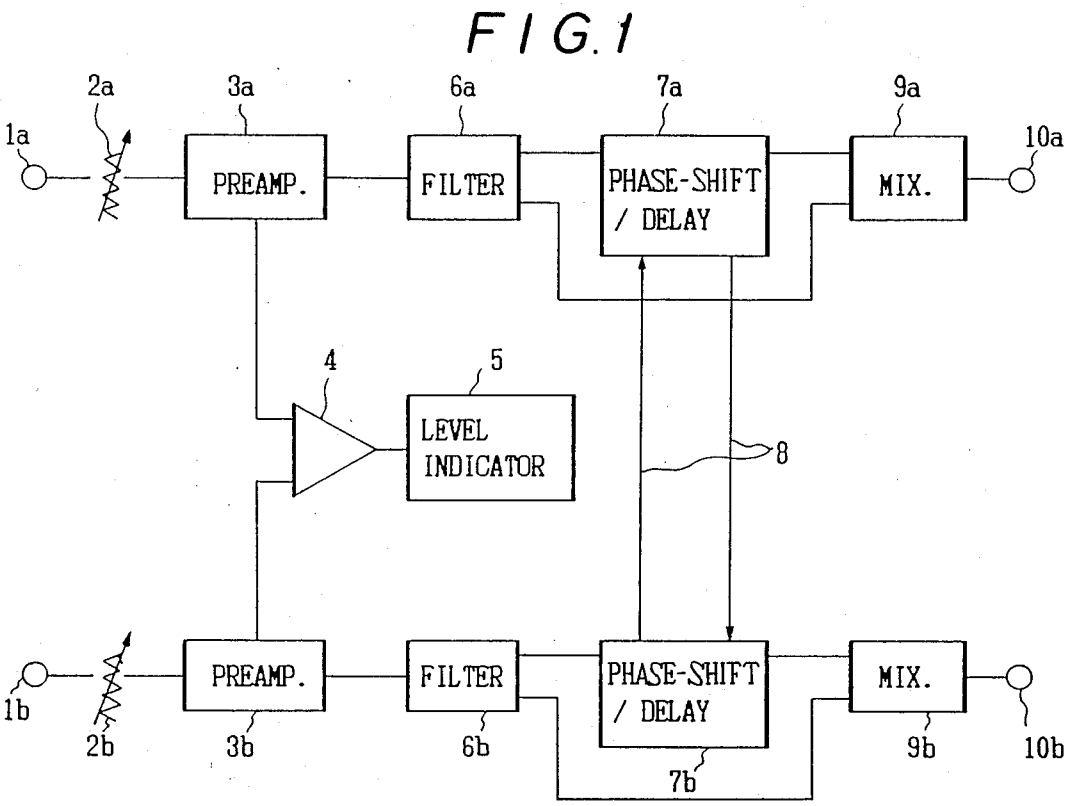
FIG. 1 is a block diagram of an encoder for a stereo processing system according to one embodiment of the present invention.

FIG. 1 is a block diagram of an encoder for a stereo processing system according to one embodiment of the present invention. The stereo processing system has a left channel and a right channel.

In the FIG. 1*a*, 1*b* are input terminals for the encoder, which receive stereophonically recorded audio signals (source) in the left and the right channels, respectively. 2*a*, 2*b* are input-level volume controls and 3*a*, 3*b* are preamplifiers. 4 is a level indicating amplifier and 5 is a level indicator for indicating the levels of the inputs to the preamplifiers 3*a*, 3*b*, individually. 6*a*, 6*b* are filter circuits each of which has one input and two outputs and separates or divides the corresponding audio signal (source) input through the corresponding preamplifier 3*a* or 3*b* into multiple bands for separate frequency ranges. This band separation is for preventing differences in phase shifts among high, middle and low frequency ranges, which would otherwise occur, from being developed when phase differences are given to the source. 7*a*, 7*b* are phase-shift circuit/delay circuits, to each of which a portion of the corresponding source, having been divided into multiple bands by the corresponding filter circuit 6a or 6b, is input. Each of the phase-shift circuits/delay circuits 7a, 7b carries out phase shifting and delaying (signal correction) to each of the separated frequency ranges (bands) of the source so as to provide a phase localization and an expanding or spreading effect. Each of the phase-shift circuits/-delay circuits 7a, 7b carries out phase shifting and delaying for all of the corresponding bands except one band. The phase-shift circuits/delay circuits 7a, 7b are interconnected by a pair of input/output lines 8 so as to cancel mixed audio signals of the left and the right channels. 9a, 9b are mixing amplifiers in the left and the right channels, respectively, connected to the outputs of the phase-shift/delay circuits 7a, 7b, respectively, and to one of the two outputs of the filters 6a, 6b, respectively, as shown in FIG. 1. The mixing amplifiers 9a, 9b mix the band-separated and corrected (phase-shifted and delayed) audio signals received through the phase-shift-/delay circuits 7a, 7b, respectively, with the band-separated but uncorrected signals received directly from the filter circuits 6a, 6b, respectively, and output the so mixed signals through output terminals 10a, 10b, respectively.

Prior to describing the operation of the encoder as mentioned above, the localization of the sounds reproduced from loudspeakers according to the conventional stereo processing system will be described.

Figure 2:
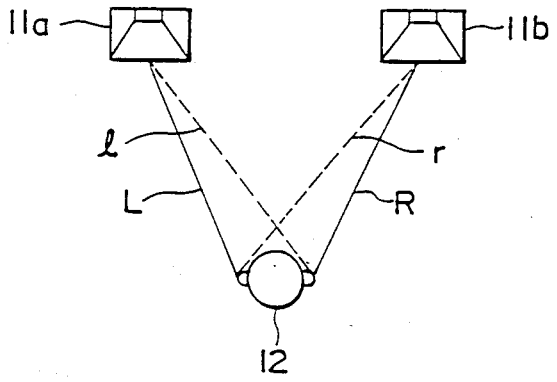
FIG. 2 is an explanatory view showing paths of sounds from loudspeakers.

FIG. 2 is a schematic view showing paths of the sounds coming from loudspeakers to the ears of a listener.

In the FIGS. 11a, 11b are loudspeakers for left and right channels, respectively, and 12 is the listener. As illustrated, when stereophonic source sound are reproduced through the left and the right loudspeakers, the listener 12 hears the sounds which include the mixed sounds of the left and the right channels. More specifically, referring now to the left channel, the sound output from the loudspeaker 11a reaches not only the left ear of the listener 12 through the path L, but also the right ear of the listener through the path 1. Similarly, the sound from the loudspeaker 11b reaches the listener through the paths R and r. The resultant mixed sounds will give the listener 12 a sensation of localization different from the audio perspective which would be given by the original sounds reaching the stereo microphone system.

In contrast to the conventional system as mentioned above, the encoder of FIG. 1 divides the source sound signals into multiple bands for separate frequency ranges by the filter circuits 6a, 6b and mixes a portion of the left channel audio signals into the right channel audio signals and mixes a portion of the right channel audio signals into the left channel audio signals through the phase-shift circuits/delay circuits 7a, 7b, respectively, and by way of the interconnecting input/output lines 8. More particularly, the audio signal in the left channel is corrected by the phase-shift circuits/delay circuits 7a, 7b and reproduced into a sound through the loudspeaker of the right channel to offset the sound in the path 1 of FIG. 2. The audio signal in the right channel is also processed in a similar way. By this processing, the sound reproduced from the left channel reaches the left ear of the listener and the sound reproduced from the right channel reaches the right ear even when the sounds are reproduced through the loudspeakers. With this respect, a time difference between the sounds reaching to the left and the right ears may be corrected to impart a sound expanding or spreading sensation. This provides the listener the same audio perspective as he would get at the original sound source.

By changing the delay time and adjusting the level of the negative-phase-sequence component, the sound image location may be moved. This will give the listener a realistic audio perspective.

In the separation of the source audio signals into the respective multiple bands by the filter circuits 6a, 6b, the levels of the respective bands may be finely adjusted to move the sound image location from side to side.

Figure 3:
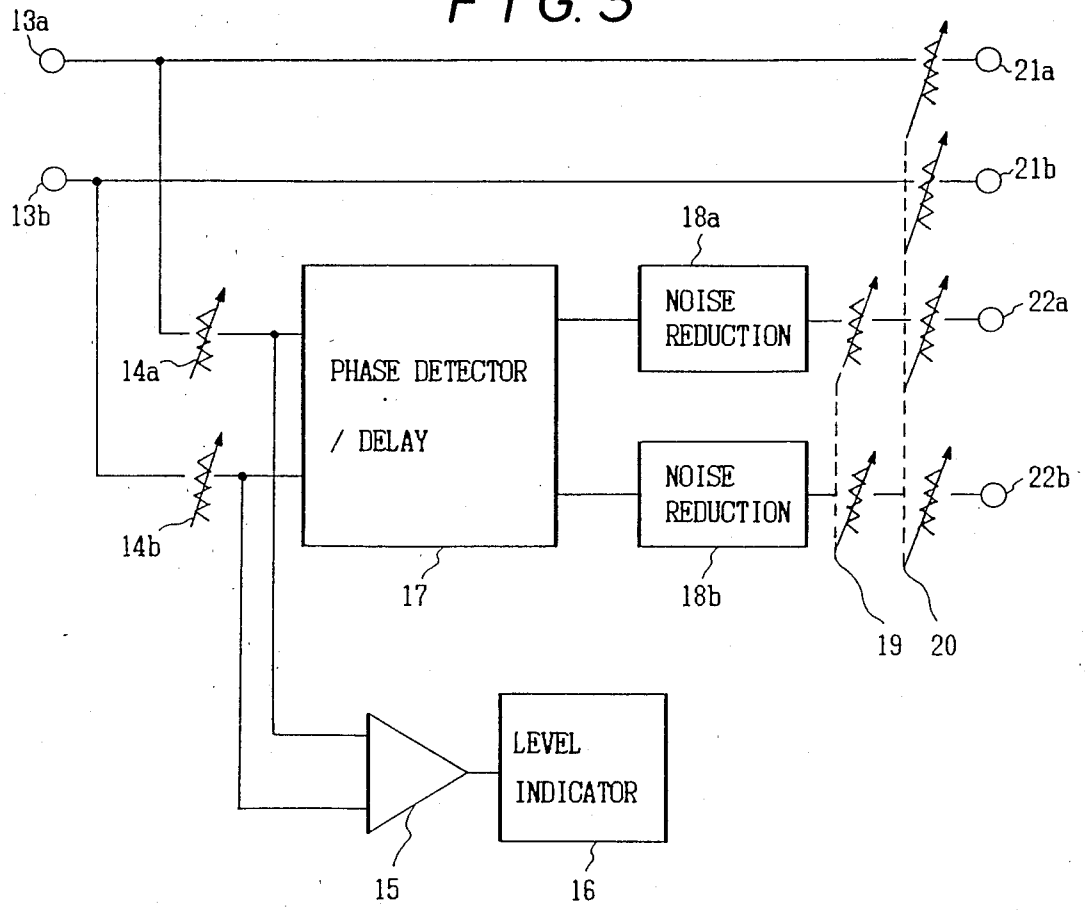
FIG. 3 is a block diagram of a decoder for the stereo processing system according to the embodiment of the present invention.

FIG. 3 is a block diagram of a decoder for the stereo processing system according to the embodiment of the present invention.

In the FIGS. 13a, 13b are input terminals of the decoder which are connected to output terminals 10a, 10b of the encoder, respectively. 14a, 14b are input-level volume controls. 15 is a level indicating amplifier and 16 is a level indicator which indicates the levels of the inputs to the decoder.

17 is a phase detector circuit/delay circuit which extracts 180° phase-shifted (inverted-phase) components from the outputs of the encoder by the phase detector circuit and corrects the phase locations by the delay circuit. 18a, 18b are noise reduction systems which decrease noise components in the respective outputs from the phase detector circuit/delay circuit 17. 19 is a rear level volume control and 20 is a master volume control. 21a, 21b are front output terminals and 22a, 22b are rear output terminals.

With the arrangement as described above, the outputs from the output terminals 10a, 10b of the encoder are input to the respective input terminals 13a, 13b of the decoder and portions of the inputs are output as is without being subjected to further processing through the front output terminals 21a, 21b. More specifically, the sounds for which the mixed audio signals have been cancelled and the phase shifts have been corrected are reproduced through the front loudspeakers. Thus, the sound field is extended to the sides of the listener. At the same time, the outputs from the encoder output terminals 10a, 10b are further input to the phase detector circuit/delay circuit 17, where only 180° phase-shifted (inverted-phase) components, with respect to the audio signals of the respective opposite channels (received from the output terminals 10b, 10a, respectively, or the outputs or the mixing amplifiers 9b, 9a, respectively), are extracted and are further subjected to phase location correction so as to be reproduced from the rear loudspeakers. This gives the listener a sound field formed by the sounds from the rear side.

Figure 4:
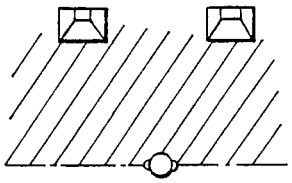
FIG. 4(*a*) is an explanatory view showing spatial localization obtained by a phase-shift circuit and a delay circuit; (b) is an explanatory view showing spatial localization obtained by a Dolby stereo system; and (c) is an explanatory view showing spatial localization obtained by the stereo processing system according to the embodiment of the present invention.
Figure 4:
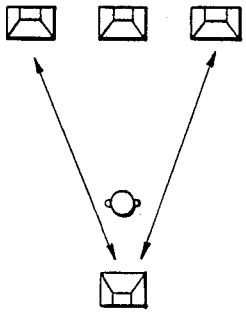
Figure 4:
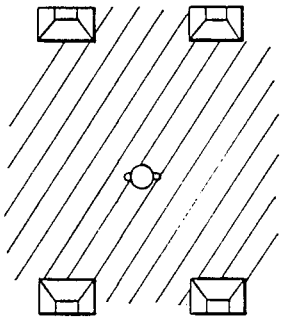

FIG. 4 includes schematic views each showing a spatial localization. FIG. 4(*a*) is a schematic view showing a spatial localization obtained when mixed sounds are cancelled by the phase-shift circuit and the delay circuit to give a sensation of expansion or spread. FIG. 4(*b*) is a schematic view showing a spatial localization obtained according to a Dolby stereo system. FIG. 4(*c*) is a schematic view showing a spatial localization obtained by the stereo processing system according to the present invention.

First, the mixed sounds are cancelled by the phase-shift circuit and the delay circuit to impart a sensation of expanding or spreading. In this case, the localization is set within the shadowed range shown in FIG. 4(*a*). However, the sound field thus constituted only extends, at the farthest, to the sides of the listener, by reason of the phase shift. Therefore, the back and forth movements of the sounds can not be reproduced.

In the Dolby system as illustrated in FIG. 4(*b*), sounds having a phase difference of 180° are reproduced from the rear loudspeaker in a monophonic way. This will give back and forth movements of the sounds but will give no spatial localization. Furthermore, the sounds are heard by the listener coming from the rear loudspeaker as no more than a sound source. Thus, a spatial sound field is not reproduced.

In contrast to those conventional systems, the stereo processing system of the present invention can provide a 360° sound field and a spatial localization as illustrated in FIG. 4(*c*). This effect can be realized by, first, constituting a spatial localization in which a sound field is formed by the encoder to the sides of the listener, and by further making stereophonic sound reproduction by the decoder from the rear of the listener. More specifically, such a spatial localization can be realized in that the original sounds which reached the microphone from the rear side at the original site can be replicated and heard by the listener from his rear side and the original sounds which came from the sides at the original site can be heard from the respective sides of the listener although there are no loudspeakers on the sides of the listener.

The output terminals 10*a*, 10*b* of the encoder may be used as signal output terminals to be connected to an auxiliary audio device. For example, an auxiliary device such as a stereophonic tape recorder may be connected. In this case, sounds providing a sensation of expansion or spread may be recorded. When this tape recorded is connected to an ordinary stereo processing system to reproduce the recorded sounds, a sensation of expanding or spreading at least to the sides of the listener can be obtained. Furthermore, a stereo broadcasting system may be connected to the output terminals 10*a*, 10*b* instead of the tape recorder. In this case, sounds imparted with a sensation of expansion or spread can be heard through an ordinary stereo receiver.

Alternatively, the input terminals 13*a*, 13*b* of the decoder may be used as signal input terminals for an auxiliary audio device. When the tape recorder as mentioned above is used as the auxiliary device, the same effect as the present invention would provide can be attained.

In this connection, it is to be noted that the present invention is not limited to the embodiment as described above, but includes various changes and modifications within the scope of the present invention. For example, the separation of the source audio signals into multiple bands is not limited to three per channel, but the audio signals may be separated more finely. The now independently formed stereo channels may alternatively be formed integral as far as the functional isolation of a channel from the other can be assured. with respect to the master volume control, it may be constructed in such a way that it can control the respective loudspeakers independently or it may be made to vary the sensation of the auditory perspective.

What is claimed is

1. A stereo processing system having a first channel circuit and a second channel circuit, which comprises:

(a) a first filter coupled to said first channel circuit for separating an audio signal input to said first channel circuit into a plurality of bands, said first filter having a first output for outputting a first portion of an output signal thereof and a second output for outputting a remaining portion of the output signal thereof;

(b) a second filter coupled to said second channel circuit for separating an audio signal input to said second channel circuit into a plurality of bands, said second filter having a first output from outputting a first portion of an output signal thereof and a second output for outputting a remaining portion of the output signal thereof;

(c) a first phase-shift/delay circuit coupled to said first channel circuit for receiving the first portion of the output signal of said first filter from the first output thereof and phase-shifting and delaying the received signal for each of the bands separated by said first filter;

(d) a second phase-shift/delay circuit coupled to said second channel circuit for receiving the first portion of the output signal of said second filter from the first output thereof and phase-shifting and delaying the received signal for each of the bands separated by said second filter;

(e) a pair of input/output circuits interconnecting said first phase-shift/delay circuit and said second phase-shift/delay circuit for inputting a signal from said second phase-shift/delay circuit to said first phase-shift/delay circuit and inputting a signal from said first phase-shift/delay circuit to said second phase-shift/delay circuit for mixing a signal received from said first filter with the signal received from said second phase-shift/delay circuit in said first phase-shift/delay circuit and for mixing a signal received from said second filter with the signal received from said first phase-shift/delay circuit in said second phase-shift/delay circuit, respectively;

(f) a first mixing circuit coupled to said first channel circuit so as to mix a signal received from the second output of said first filter with an output signal of said first phase-shift/delay circuit;

(g) a second mixing circuit coupled to said second channel circuit so as to mix a signal received from the second output of said second filter with an output signal of said second phase-shift/delay circuit; and (h) a phase detector-delay circuit coupled to the output of said first mixing circuit and the output of said second mixing circuit for detecting and delaying a portion of the output signal from said first mixing circuit having a 180° phase-shift with respect to the output signal from said second mixing circuit and a portion of the output signal from said second mixing circuit having a 180° phase-shift with respect to the output signal received from said first mixing circuit, respectively.

2. A stereo processing system as set forth in claim 1, wherein each of said first and second phase-shift/delay circuits carries out phase shifting and delaying with respect to its corresponding plurality of bands except for one band.

3. A stereo processing system as set forth in claim 1, wherein said first and second mixing circuits have respective signal output terminals so that said stereo processing system may be connected to an auxiliary audio device thereby.

4. A stereo processing system as set forth in claim 1, wherein said phase detector/delay circuit has signal input terminals so that said stereo processing system may be connected to an auxiliary audio device thereby.

5. A stereo processing system as set forth in claim 2, wherein said first and second mixing circuits have respective signal output terminals so that said stereo processing system may be connected to an auxiliary audio device thereby.

6. A stereo processing system as set forth in claim 2, wherein said phase detector/delay circuit has signal input terminals so that said stereo processing system may be connected to an auxiliary audio device thereby.

* * * * *